US005753083A

United States Patent [19]

Schiel et al.

[11] Patent Number: 5,753,083

[45] Date of Patent: May 19, 1998

[54] HYDRAULIC SUPPORT ARRANGEMENT FOR A SHOE PRESS DEVICE

[75] Inventors: Christian Schiel; Andreas Schuette; Ulrich Wieland, all of Heidenheim; Wolfgang Schuwerk, Kisslegg; Joachim Grabscheid, Heuchlingen, all of Germany

[73] Assignee: Voith Sulzer Papiermaschinen GmbH, Germany

[21] Appl. No.: 662,112

[22] Filed: Jun. 12, 1996

[30] Foreign Application Priority Data

Jun. 27, 1995 [DE] Germany ..... 195 22 761.1

[51] Int. Cl.[6] ..... D21F 3/02; D21F 3/08

[52] U.S. Cl. ..... 162/358.3; 162/358.1; 162/361; 100/153

[58] Field of Search ..... 162/358.3, 361, 162/205, 195, 358.1; 100/153, 118, 93 RP; 492/4, 7, 20

[56] References Cited

U.S. PATENT DOCUMENTS

| | | | |
|---|---|---|---|
| 4,556,454 | 12/1985 | Dahl et al. | 162/358 |
| 4,570,314 | 2/1986 | Holik et al. | 492/4 |
| 5,140,897 | 8/1992 | Olson | 100/153 |
| 5,507,916 | 4/1996 | Schiel | 162/195 |

FOREIGN PATENT DOCUMENTS

| | | | |
|---|---|---|---|
| 0 254 819 | 2/1988 | European Pat. Off. | D21F 3/02 |
| 4017433 | 4/1991 | Germany . | |
| 4319323 | 11/1993 | Germany . | |
| 4321400 | 11/1993 | Germany . | |
| 564381 | 7/1975 | Switzerland . | |
| 91/0591 | 5/1991 | WIPO | D21G 1/00 |

OTHER PUBLICATIONS

European Search Report dated 5 Nov. 1996.

*Primary Examiner*—Donald E. Czaja
*Assistant Examiner*—Jose A. Fortuna
*Attorney, Agent, or Firm*—Ostrolenk, Faber, Gerb & Soffen, LLP

[57] ABSTRACT

A shoe press device for treating a web, particularly for dewatering a web. A shoe press roll has a beam and a flexible press jacket around the beam. A press shoe on the beam presses the press jacket against a backing roll to define a press nip. Support elements supported on the beam press on the shoe. The support elements are in a first plurality along the shoe and a respective second plurality toward each end of the shoe. The second support elements are smaller in size with reference to their pressure area on the shoe, and there is one or more rows of second pressure elements at each end of the shoe. Different respective pressures may be applied to the main and second pluralities of support elements. The backing roll may be a sag adjustment roll including a rotatable roll jacket and support elements in the sag adjustment roll pressing on the roll jacket. The support elements in the sag adjustment roll may be similar in size with reference to the area exposed to the roll jacket and similar to or greater by one in number than the first support elements for the shoe press roll. Various devices control the pressure to the first, second and sag adjustment roll support elements.

23 Claims, 4 Drawing Sheets

10
11
13
14
15
16
18
19
20
21
22
23
25
28
29
30
B
II
II

HYDRAULIC SUPPORT ARRANGEMENT FOR A SHOE PRESS DEVICE

BACKGROUND OF THE INVENTION

The present invention relates to a shoe press constructed according to Federal Republic of Germany 43 19 323 A1, which corresponds to U.S. Pat. No. 5,507,916, and particularly relates to the pressure supplies to the supporting shoe of a shoe press device. The above German patent discloses the following features:

A shoe press device serves for treating, for instance dewatering, a traveling web of material, for instance, a paper or board web. The device extends over the entire maximum width of the web. A flexible revolving press jacket can be pressed on its interior in a press plane by a press shoe. The shoe is supported on a stationary support body and is pressed by hydraulic pressure in the support body against the press jacket interior which is in turn pressed against a backing element, for instance a backing roll. Between the support body and the press shoe and along their length there are a plurality of support elements which provide the pressing force on the shoe. The support elements can be acted on, individually or in groups, with different pressures applied by a pressure agent.

In the press device of the invention, the support elements are preferably developed as ring shaped, circular shaped elements in the region of the support body directed at the press shoe. The interiors of the support elements can be connected to a source of pressure agent. This is also known from the above reference, Germany '323. In that publication, the main object is to obtain a sensitively adjustable relief at the edge, and to do so by the simplest possible connection or disconnection of the pressure of the pressure agent to individual support elements. This is a stepwise method. It reduces the expense for the control, which would be necessary if the pressure had to be adjustable steplessly, i.e., continuously in individual support elements. In order to achieve this object, Germany '323 discloses two or three rows of relatively small support elements provided along the length of the press shoe. However, this has the disadvantage that, as a whole, an enormously large number of support elements are necessary, about 10 to 20 per meter width of the web. Even in the case of rational production, the expense for this is considerable.

SUMMARY OF THE INVENTION

The object of the present invention is therefore to create a press device which can be produced at less expense, as compared with the known construction, and which nevertheless affords the possibility of varying the distribution of the pressing force as desired over the width of the web. In particular, sensitive adjustable edge relief should be possible using simple means.

The invention concerns a shoe press device for treating a web, particularly for dewatering a web. A shoe press roll includes a beam and a flexible press jacket around the beam. A press shoe supported by the beam presses against the interior of the press jacket and presses the jacket against a backing roll to define a press nip. Support elements, which are supported on the beam in the shoe press roll, press on the shoe. The support elements are in a first plurality of main elements across the shoe and a respective second plurality of elements toward each end of the shoe. The second support elements each define smaller size pressure areas acting on the shoe. There is one or more circumferential rows of second support elements at each end of the shoe. Different respective pressures may be applied to the main and second pluralities of support elements.

The shoe presses the press jacket against a backing element, preferably a backing roll. The backing roll may be a sag adjustment roll which includes a rotatable roll jacket and a plurality of support elements in the sag adjustment roll and pressing on the roll jacket. The backing roll support elements may be substantially similar in size with reference to the area exposed to the roll jacket and similar in number to or greater by one in number than the main support elements for the shoe press roll. Various devices control the pressure to the main, second and sag adjustment roll support elements.

Relatively few support elements, which can therefore be produced at a favorable cost, are available for producing the greatest part of the entire pressing force on the press shoe. The dimensions of the support elements in the direction of travel of the web, i.e., their dimensions around the circumference of the press roll, are preferably only slightly smaller than the width of the press shoe measured in the same direction. In addition, on at least one of the two lateral ends of the roll at least two relatively small area edge support elements are provided, arranged one behind the other in the direction of travel of the web. In different geometric variants, it is also possible to provide one end of the roll with a group of between three and six, possibly also eight or ten, small edge support elements, distributed in two or three rows of such elements along the length of the press shoe.

All the main support elements are preferably fed from the same main source of pressure. For feeding the smaller edge support elements, on the other hand, there are numerous different possibilities, explained below. On at least one of the two ends of the roll, the edge support elements are connected by at least one pressure reduction valve or a simple ON-OFF valve to the main source of pressure. As an alternative, at least one separate source of pressure is provided for the edge, which supplies the edge support elements with pressure medium independently of the main support elements. Thus, any desired values of pressure can be produced in the edge support elements, and these pressures may be lower or may even be higher than the pressure in the main support elements.

It is also possible for the edge support elements, or a part of them, to be adapted to be temporarily connected by a switch device to the main source of pressure or to an additional source of edge pressure.

The arrangement of the edge support elements and their control need not necessarily be symmetrical, i.e. uniform at the two roll ends. Rather, asymmetric arrangements and control devices are also possible. This is true, for instance, when the web being treated has temporarily a narrower web width than the maximum web width. In this case, it is advantageous for the narrower web to travel flush with one of the two edges at the maximum web width position through the pressing device so that, in particular, the devices for threading the web, which are generally located at the operator side edge zone, can still be used.

Other features of the invention concern the special case wherein the backing roll, which opposes the press shoe press roll discussed above, is a sag adjustment roll having a roll jacket which can also be supported by a number of backing roll jacket support elements that are at a stationary support body inside the backing roll. These backing roll support elements are preferably fed from the same source of pressure as the support elements of the shoe press device.

The sag adjustment backing roll can also have individually controlled edge support elements which are smaller in their pressure areas exposed to the roll jacket than the other main support elements of that roll. In a preferred embodiment, however, the backing roll has only relatively large pressure area main support elements, which can be produced at favorable cost.

In a particular embodiment of the invention, the sag adjustment roll has only relatively large main support elements, while the shoe press device, also called a "shoe press roll", has main support elements and, at each edge zone, also has two relatively small edge support elements arranged one behind the other in the direction of travel of the web.

All support elements are developed as circular elements in their respective support bodies. The main support elements of the shoe press device and those of the sag adjustment roll have the same diameter. The number of main support elements in the shoe press device can be one fewer than in the sag adjustment roll, so that, as seen in a view in a longitudinal elevation of the entire press device, a zig zag arrangement of the main support elements is present. At other times, however, it is advantageous for the number of the main support elements in both rolls to be equal. In that case, edge support elements are omitted from the sag adjustment roll when the shoe press roll lies below the sag adjustment roll and when, therefore, the support elements in the sag adjustment roll act on the roll jacket in the same direction as gravity.

Other features and advantages of the present invention will become apparent from the following description of the invention which refers to the accompanying drawings.

DETAILED DESCRIPTION OF EMBODIMENTS OF THE INVENTION

Figure 1:
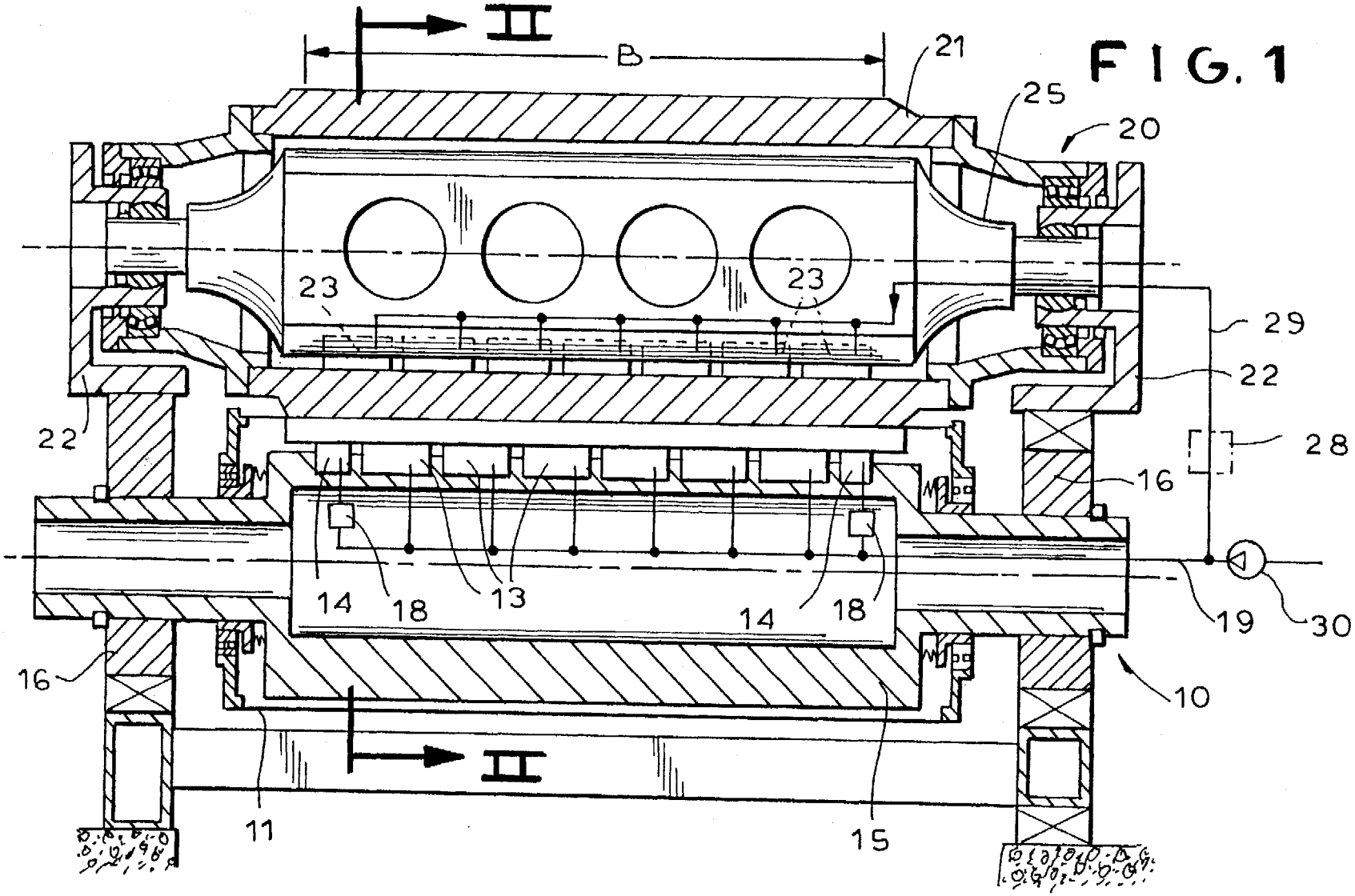
FIG. 1 is a longitudinal section through a complete press device comprising a shoe press device and a sag adjustment roll.
Figure 2:
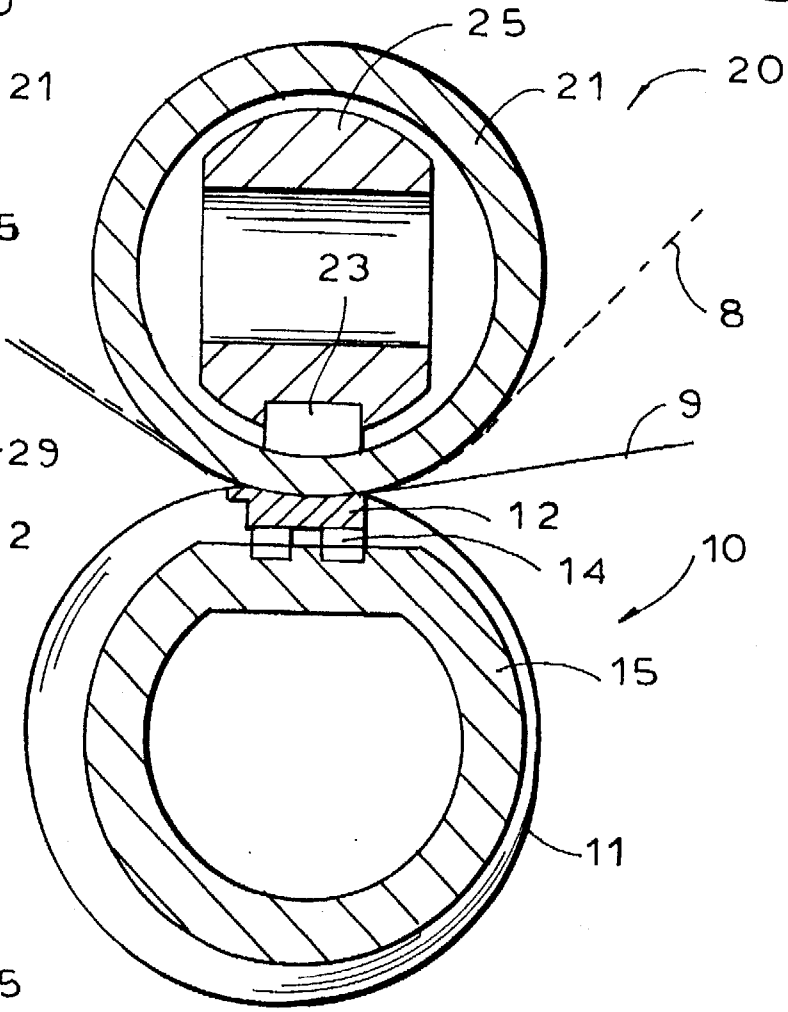
FIG. 2 is a cross section thereof.

FIG. 1 shows a shoe press device or "shoe press roll" 10. It cooperates with a backing element in the form of a sag adjustment roll 20 which is arranged above the roll 10 to form a lengthened or extended press nip, in the direction of travel of the web. A web of paper from which water, for instance, is to be removed travels through the nip perpendicular to the plane of the drawing. The web has, for instance, a width value B. See the paper web 9 and dewatering felt 8 in FIG. 2.

The shoe press device comprises a flexible, endless loop, rotatable press jacket 11 of a width greater than the width B of the web 9 and which rotates around a central beam. A press shoe 12 is located inside the press jacket, in the plane of contact with the other sag adjustment roll 20. The shoe extends over the width of the web. The shoe 12 is supported by first and second pluralities of main support elements 13, 14 supported on a stationary support body 15 about which the jacket 11 rotates. The support elements act between the support body and the press shoe. The support body rests at both ends in machine frames 16.

The support elements have only been shown diagrammatically in the drawing. They are preferably developed according to German Patent Application No. 195 14 142.3 of Apr. 15, 1995, which corresponds to U.S. application Ser. No. 08/628,470, filed Apr. 5, 1996, and incorporated by reference. As an alternative to the arrangement shown in FIG. 1, the backing roll 20 can also be arranged below the shoe press device 10.

Figure 3:
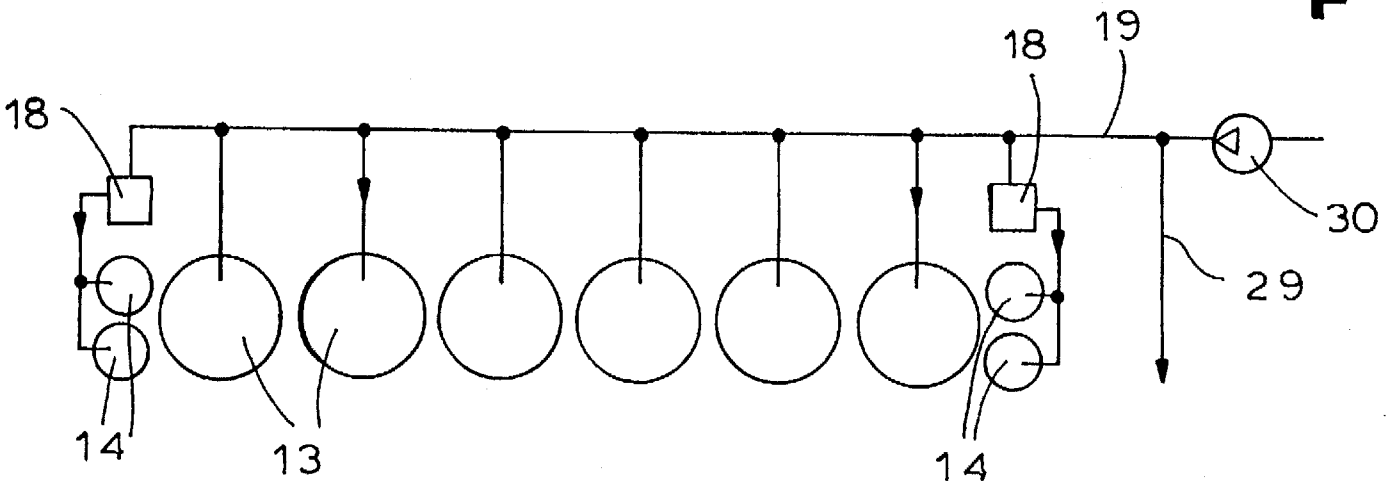
FIGS. 3 to 6 diagrammatically show different combinations of main and edge support elements.

Similar to FIG. 3, the shoe press device 10, has a single row with a first plurality of main support elements 13, for instance six, arrayed along the roll and in the plane of contact with the roll 20. Furthermore, at each end of the roll, a second plurality of two substantially smaller edge support elements 14 are arranged one after the other in the direction of travel of the web. The elements 14 at each end are preferably dimensioned, and pressurized, as described below, so that the sum of the support forces of the two elements 14 is as close as possible to one half the support force provided by a main support element 13.

The sag adjustment roll 20 in FIG. 1 has a metallic, relatively thick and relatively inflexible roll jacket 21, as compared with the press jacket 11 on the roll 10. The roll jacket 21 rests, via bearing necks and antifriction bearings, in bearing brackets 22 at its opposite ends. A stationary yoke 25 is also supported inside the jacket 21 in the same bearing brackets. Between the yoke 25 and the roll jacket 21 there is a single row of support elements 23 which lie directly opposite the support elements 13, 14 of the shoe press device in the same press plane. The flexible press jacket 11 presses on the inflexible roll jacket 21 and the support elements 23 transmit the force that is applied to the roll jacket to the stationary yoke 25. The support elements 23 of the sag adjustment roll have substantially the same area toward the roll jacket as the corresponding dimension of the support elements 13 of the shoe press device. The number of support elements 23 at the sag adjustment roll 20 is one greater than the number of support elements 13 in the shoe press device 10. The elements 23 are arranged spaced apart and offset along the length of the shoe from the elements 13 of the shoe press device by half the distance between the axes of the two adjacent elements 23.

The hydraulic support of the support elements 13, 14 and 23 takes place via pressure agent lines 19 and 29 which are preferably fed with pressurized hydraulic liquid from a common pressure agent source 30. A pressure reduction valve 28 can be provided in one of the lines 19 or 29 for instance if it is necessary to support the weight of the roll jacket 21 itself.

FIG. 3 shows the conduit system for supplying pressure agent to the support elements 13 and 14 of the shoe press device 10. It includes the pump 30, the pressure agent lines 19 and 29 from the pump and the branch lines leading to the main support elements 13 and to the edge support elements 14. The pressure in the elements 14 can be lowered, if necessary, as compared with the pressure prevailing in the line 19 and in the elements 13, by pressure reduction valves 18.

Figure 4:
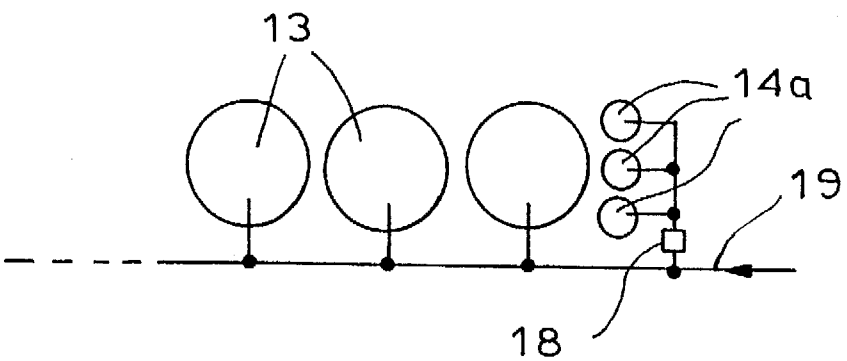

FIG. 4 illustrates that the edge region at each end of the roll can be narrowed in its lateral width by providing not only two, but three even smaller diameter, as exposed to the press shoe, edge support elements **14*a*** which lie one after the other in the direction of travel of the web.

Figure 5:
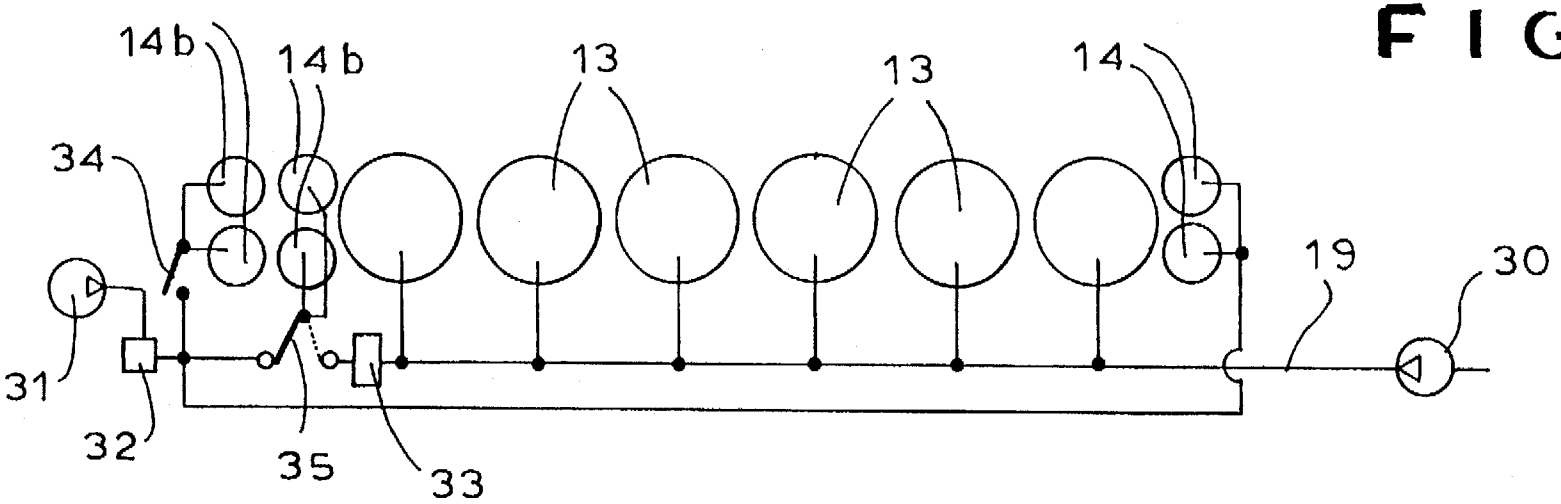
Figure 6:
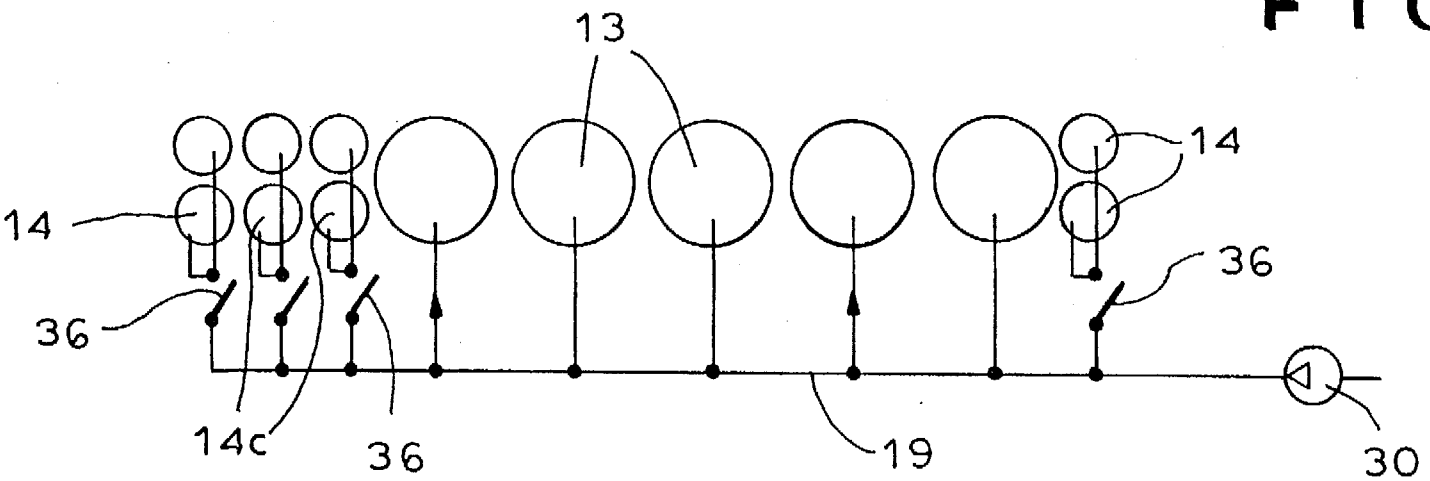

In FIGS. 5 and 6, the opposite edge zones have support elements that are of different widths, differing from FIGS. 1 and 3. Thus, in the example of FIG. 5, an additional row of two edge support elements **14*b* is provided at one of the two ends of the roll. The entire press device is developed correspondingly longer. This enables somewhat wider webs to also optionally be worked. For instance, one edge of the web, e.g., the edge on which a tail may be formed, is placed at the elements 14, and its other edge extends to only one or both rows of elements 14***b*, dependent upon the width of the web. An additional source of pressure agent 31 is provided for the edge support elements, which, if necessary, can supply a higher or lower pressure than the pressure agent source 30. Pressure regulating valves 32, 33, an ON-OFF valve 34, and a switch valve 35 make it possible to control the pressures prevailing in the edge support elements as desired, even to having each row 14*b* at a respective pressure as the particular web requires.

The system in FIG. 6 has the same overall length as that of FIG. 3. One difference from FIG. 3 is that the first one of the main support elements 13 is replaced by a group of four edge support elements 14*c*. The elements 14*c* are preferably so dimensioned at the end exposed to the shoe that the sum of their support forces is approximately equal to the support force of one main support element 13. Each row of edge support elements can be closed, if desired, by an ON-OFF valve 36, or can be switched from a relatively high pressure to a relatively low pressure, which may be atmospheric pressure. For different web widths, this is the simplest method of optionally connecting the edge zones of the press shoe 12 with full pressure, or of relieving them of pressure, within what is possibly based on the yieldability of the press shoe 12.

Figure 7:
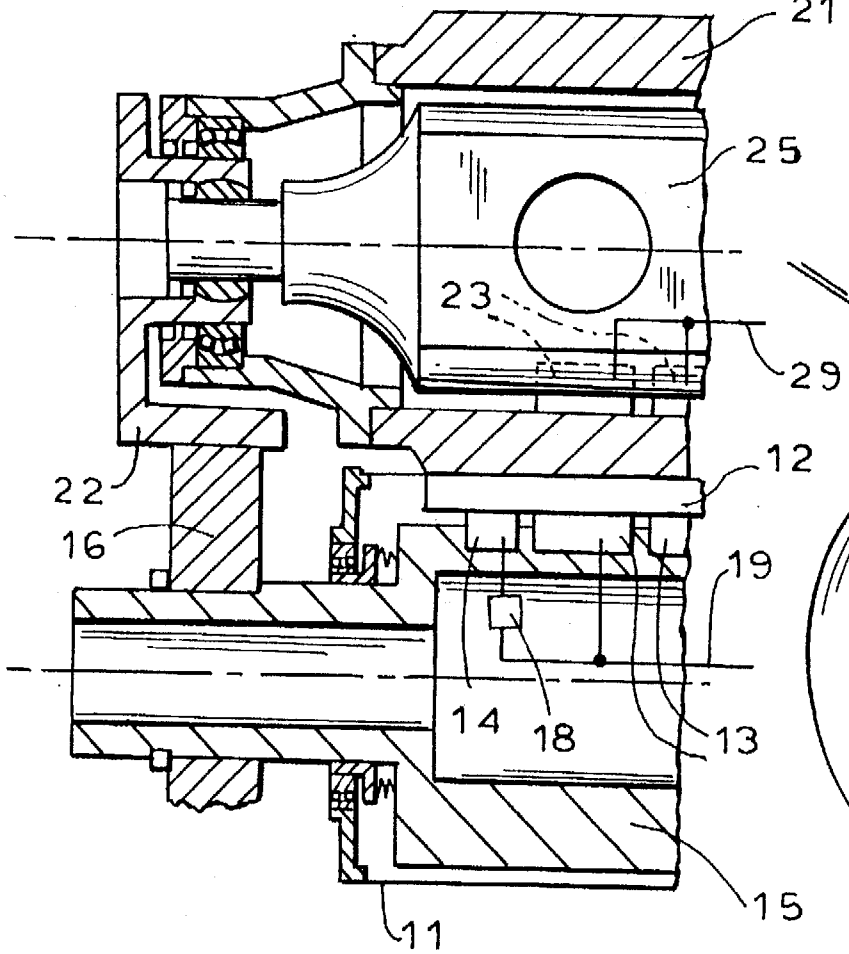
FIG. 7 shows a variant of FIG. 1.

In the variant shown in FIG. 7, the number of support elements 23 of the backing roll 20 equals the number of main support elements 13 of the shoe press roll 10. They are arranged so that the support elements 13 and 23 are opposite each other in pairs. The backing roll 20 could also have edge support elements opposite the edge support elements 14 of the shoe press roll 10. Such support elements, however, have been omitted in the example shown.

The pressure supplied to each support element 13, 14 or 23 is selected according to the requirements for dewatering a particular web. For example, in FIG. 6, the smaller support elements 14 may receive a lower pressure than the elements 13 or may even be disconnected from a pressure source. In other Figures, the elements 14 may receive lower pressure than the elements 13.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A shoe press device for treating a traveling web, the press device comprising:

a stationary support body;

a flexible rotatable press jacket passing around the support body and having a width which is at least the width of the web being treated, wherein the press jacket is pressable against a backing element for defining a press nip;

a press shoe supported on the support body, the shoe extending along the width of the press jacket and the shoe being pressure supportable to press the press jacket against the backing elemental the press nip;

first and second pluralities of support elements each communicating between the support body and the press shoe at a respective region of the shoe adjacent that support element for pressing the shoe toward the press jacket, the support elements being arrayed along the length of the shoe and along the width of the press jacket;

the first plurality of support elements being generally more in the central region of the width of the press jacket; the second plurality of support elements also each communicating between the support body and the press shoe but being at least toward one of the ends of the press shoe toward one of the lateral edges of the press jacket; and a pressurizing device for delivering pressure to the first and second plurality of support elements and for selectively delivering different levels of pressure to the first and second plurality of support elements so that the pluralities may act with different respective pressures on their respective regions of the press shoe;

wherein two of the second plurality of support elements toward one end of the press shoe are dimensioned in their areas toward the press shoe so that together they produce at least approximately half of the pressure of the next adjacent support element of the first plurality of support elements, and wherein the support elements of the first and second pluralities are of different respective sizes in their areas acting on the press shoe.

2. The shoe press device of claim 1, further comprising pressure delivery means for delivering pressure to the first and second support elements, and the pressure delivery means including adjusting means therein for adjusting the respective levels of pressure delivered to the first and second support elements for giving those support elements selectively different pressures.

3. The shoe press device of claim 2, wherein the pressure to the second support elements is controlled independently of the pressure to the first support elements.

4. The shoe press device of claim 2, wherein toward at least one end of the press shoe, the second support elements are arranged in at least two rows of such support elements in the direction around the support element, and each row having at least two of the second support elements, and the second support elements toward the one end of the press shoe are dimensioned in their areas toward the press shoe for together producing substantially the same pressure as one of the first support elements.

5. The shoe press device of claim 1, wherein the first plurality of support elements are arranged in a single row and each has relatively larger area acting on the press shoe.

6. The shoe press device of claim 5, wherein the second plurality of support elements toward at least one end of the shoe comprise at least two of the second support elements which are located one after the other in the direction of travel of the press jacket through the press nip.

7. The shoe press device of claim 6, wherein the second plurality of support elements are arranged in a row in the travel direction of the press jacket.

8. The shoe press device of claim 6, wherein each of the second plurality of support elements is smaller in its area acting on the press shoe than each of the first plurality of support elements.

9. The shoe press device of claim 6, wherein there is a respective second plurality of support elements toward each end of the press shoe.

10. The shoe press device of claim 9, wherein there is an equal number of second support elements toward each end of the shoe.

11. The shoe press device of claim 9, wherein there is an unequal number of second support elements toward each end of the shoe.

12. The shoe press device of claim 11, wherein at each end of the press shoe, the second support elements are arranged in at least one row, one behind the other, in the direction of travel of the press jacket and there are a plurality of the rows toward at least one end of the press shoe.

13. The shoe press device of claim 1, further comprising the backing element for the press jacket comprising a sag adjustment backing roll having a yoke, a rotatable roll jacket supported to rotate around the yoke and to define the press nip with the press jacket, and means at the sag adjustment roll for transmitting the force applied to the roll jacket by the flexible press jacket at the nip therebetween, the force transmission being to the yoke in the backing roll.

14. The shoe press device of claim 13, wherein the means at the sag adjustment roll comprises a row of third support elements at the stationary yoke inside the roll jacket, and the third support elements communicating with the roll jacket for transmitting to the yoke the pressure applied to the roll jacket by the press jacket.

15. The shoe press device of claim 14, wherein the pressure delivering means for the first support elements are connected with the third support elements for the backing roll.

16. The shoe press device of claim 15, wherein the pressure delivering means for the first and third support elements are operable for supplying the third support elements with at least approximately the same pressure as is supplied to the first support elements.

17. The shoe press device of claim 14, wherein each of the third support elements of the sag adjustment roll has substantially the same area toward the roll jacket as the corresponding dimension of one of the first support elements for the press shoe.

18. The shoe press device of claim 17, wherein there is one more of the third support elements of the backing roll than of the first support elements for the press jacket.

19. The shoe press device of claim 17, wherein there is the same number of the third support elements of the backing roll as the first support elements for the press shoe.

20. A shoe press device for treating a traveling web, the press device comprising:

a stationary support body;

a flexible rotatable press jacket passing around the support body and having a width which is at least the width of the web being treated, wherein the press jacket is pressable against a backing element for defining a press nip;

a press shoe supported on the support body, the shoe extending along the width of the press jacket and the shoe being pressure supportable to press the press jacket against the backing element at the press nip;

first and second pluralities of support elements each communicating between the support body and the press shoe at a respective region of the shoe adjacent that support element for pressing the shoe toward the press jacket, the support elements being arrayed along the length of the shoe and along the width of the press jacket;

the first plurality of support elements being generally more in the central region of the width of the press jacket; the second plurality of support elements also each communicating between the support body and the press shoe but being at least toward one of the ends of the press shoe toward one of the lateral edges of the press jacket;

further wherein the backing element for the press jacket comprises a sag adjustment backing roll having a yoke, a rotatable roll jacket supported to rotate around the yoke and to define the press nip with the press jacket, and a support at the sag adjustment roll for transmitting the force applied to the roll jacket by the flexible press jacket at the nip therebetween, the force transmission being to the yoke in the backing roll;

wherein the support at the sag adjustment roll comprises a row of third support elements at the stationary yoke inside the roll jacket, the third support elements communicating with the roll jacket for transmitting to the yoke the pressure applied to the roll jacket by the press jacket;

wherein each of the third support elements of the sag adjustment roll has substantially the same area toward the roll jacket as the corresponding dimension of one of the first support elements for the press shoe; and wherein there is one more of the third support elements of the backing roll than of the first plurality of support elements for the press jacket.

21. The shoe press device of claim 20, further comprising a pressurizing device for delivering pressure to the first and second plurality of support elements and for selectively delivering different levels of pressure to the first and second plurality of support elements so that the pluralities may act with different respective pressures on their respective regions of the press shoe.

22. A shoe press device for treating a traveling web, the press device comprising:

a stationary support body;

a flexible rotatable press jacket passing around the support body and having a width which is at least the width of the web being treated, wherein the press jacket is pressable against a backing element for defining a press nip;

a press shoe supported on the support body, the shoe extending along the width of the press jacket and the shoe being pressure supportable to press the press jacket against the backing element at the press nip;

first and second pluralities of support elements each communicating between the support body and the press shoe at a respective region of the shoe adjacent that support element for pressing the shoe toward the press jacket, the support elements being arrayed along the length of the shoe and along the width of the press jacket;

the first plurality of support elements being generally more in the central region of the width of the press jacket; the second plurality of support elements also each communicating between the support body and the press shoe but being at least toward one of the ends of the press shoe toward one of the lateral edges of the press jacket;

further wherein the backing element for the press jacket comprises a sag adjustment backing roll having a yoke, a rotatable roll jacket supported to rotate around the yoke and to define the press nip with the press jacket, and a support at the sag adjustment roll for transmitting the force applied to the roll jacket by the flexible press jacket at the nip therebetween, the force transmission being to the yoke in the backing roll;

wherein the support at the sag adjustment roll comprises a row of third support elements at the stationary yoke inside the roll jacket, the third support elements communicating with the roll jacket for transmitting to the yoke the pressure applied to the roll jacket by the press jacket;

wherein each of the third support elements of the sag adjustment roll has substantially the same area toward the roll jacket as the corresponding dimension of one of the first support elements for the press shoe; and wherein there is the same number of the third support elements of the backing roll as the first plurality of support elements for the press jacket.

23. The shoe press device of claim 22, further comprising a pressurizing device for delivering pressure to the first and second plurality of support elements and for selectively delivering different levels of pressure to the first and second plurality of support elements so that the pluralities may act with different respective pressures on their respective regions of the press shoe.

* * * * *